US007214409B1

(12) United States Patent
Kasule

(10) Patent No.: US 7,214,409 B1
(45) Date of Patent: May 8, 2007

(54) HIGH STRENGTH NI-PT-AL-HF BONDCOAT

(75) Inventor: Asumini Kasule, New Britain, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 11/316,635

(22) Filed: Dec. 21, 2005

(51) Int. Cl.
*B05D 3/02* (2006.01)
*C23C 28/02* (2006.01)
*C25D 3/50* (2006.01)

(52) U.S. Cl. ..... 427/383.7; 427/250; 205/264

(58) Field of Classification Search ..... 428/632, 428/633, 670, 680, 650, 652, 215, 334, 335; 427/372.2, 383.1, 383.3, 383.7, 250; 205/264
See application file for complete search history.

(56) References Cited

U.S. PATENT DOCUMENTS

| | | | | |
|---|---|---|---|---|
| 5,792,267 | A | 8/1998 | Marszal et al. | |
| 5,932,078 | A | 8/1999 | Beers et al. | |
| 5,972,185 | A | 10/1999 | Hendricks et al. | |
| 6,036,828 | A | 3/2000 | Beers et al. | |
| 6,224,726 | B1 | 5/2001 | Beers et al. | |
| 6,682,827 | B2 * | 1/2004 | Darolia et al. | 428/632 |
| 6,730,422 | B2 | 5/2004 | Litton et al. | |
| 2004/0229075 | A1 * | 11/2004 | Gleeson et al. | 428/629 |
| 2006/0127695 | A1 * | 6/2006 | Gleeson et al. | 428/670 |

* cited by examiner

*Primary Examiner*—Michael E. LaVilla
(74) *Attorney, Agent, or Firm*—Bachman & LaPointe

(57) ABSTRACT

A turbine engine component has a substrate formed from a nickel based superalloy and a Ni—Pt—Al—Hf bondcoat applied to a surface of the substrate. Two methods for forming the platinum modified Ni—Pt—Al—Hf bondcoat are described herein.

29 Claims, 1 Drawing Sheet

HIGH STRENGTH NI-PT-AL-HF BONDCOAT

BACKGROUND OF THE INVENTION (1) Field of the Invention

The present invention relates to a high strength nickel-platinum-aluminum-hafnium bondcoat for a turbine engine component and a method for forming same.

(2) Prior Art

Turbine engine components are subjected to elevated temperatures as a result of their exposure to high temperature gas. Such exposure can lead to the creation of unwanted defects in the components. To protect the components, bondcoats and/or ceramic topcoats are applied to the surfaces of the turbine engine components.

Despite the existence of such coatings, there is still a need for coatings which provide the components with improved oxidation resistance.

SUMMARY OF THE INVENTION

Accordingly, the present invention is directed to an improved coating system for a turbine engine component and methods for forming same.

In accordance with the present invention, there is provided a method for forming a coating on a substrate. The method broadly comprises the steps of providing a substrate, depositing a layer of platinum onto a surface of the substrate, depositing a nickel-aluminum-hafnium (Ni—Al—Hf) layer onto the platinum layer, and heat treating the substrate with the deposited layers to form a nickel-platinum-aluminum-hafnium (Ni—Pt—Al—Hf) bondcoat.

In accordance with the present invention, there is provided an alternative method for forming a coating on a substrate. The method broadly comprises the steps of providing a substrate, depositing a Ni—Al—Hf layer onto a surface of the substrate, depositing a layer of platinum over the Ni—Al—Hf layer, and heat treating the substrate with the deposited layers to form a Ni—Pt—Al—Hf bondcoat.

In accordance with the present invention, there is provided a turbine engine component broadly comprising a substrate formed from a nickel based superalloy and a Ni—Pt—Al—Hf bondcoat applied to a surface of the substrate.

Other details of the high strength Ni—Pt—Al—Hf bondcoat of the present invention, as well as other objects and advantages attendant thereto, are set forth in the following description and the accompanying drawings wherein like reference numerals depict like elements.

DETAILED DESCRIPTION OF THE PREFERRED EMBODIMENT(S)

As discussed, the present invention is directed to an improved coating system that can be applied to turbine engine components, such as vanes, blades, and seals, that are exposed to high temperature gases. The coating system includes a thin bondcoat that offers oxidation protection to the nickel based superalloy forming the turbine engine component. The bondcoat is a high strength Ni—Pt—Al—Hf coating. The addition of the platinum to the bondcoat improves the adherence of the aluminum oxide scale that forms during use of the turbine engine component.

Figure 1:
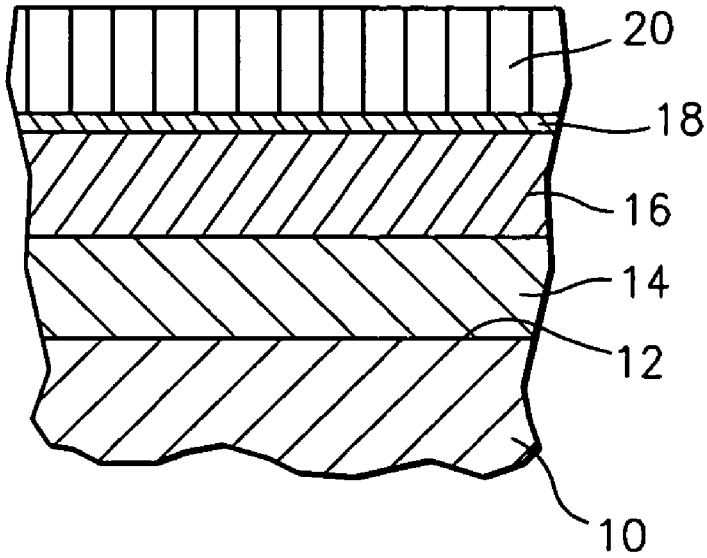
FIG. 1 is a schematic representation of a first coating system in accordance with the present invention.

FIG. 1 illustrates a first sequence for forming a coating system in accordance with the present invention. As shown therein, a nickel based alloy substrate 10 has a surface 12. A layer 14 of platinum is deposited onto the surface 12, preferably using an electroplating technique. For purposes of illustration only, a useful electroplating bath may contain platinum quantities in the range of 17 to 26 grams/liter. The current density may range from 20 to 30 amps per square foot. The time for electroplating will be determined by the required thickness. The electroplating bath temperature can go up to 200 degrees F. The layer of electroplated platinum may have a thickness in the range of from about 0.01 to 1.0 mils. These electroplating parameters are offered merely for purposes of illustration as other electroplating parameters can be employed. The platinum layer also can be deposited by techniques other than electroplating, such as including, but not limited to sputtering, and other deposition techniques.

Thereafter, a layer 16 of Ni—Al—Hf material is deposited onto the platinum layer. Preferably, the Ni—Al—Hf material is deposited using a cathodic arc deposition process. Techniques for applying the coatings of the present invention by cathodic arc plasma vapor deposition are discussed in U.S. Pat. Nos. 5,972,185; 5,932,078; 6,036,828; 5,792,267; and 6,224,726, all of which are incorporated by reference herein. Alternate methods of deposition, including other plasma vapor deposition techniques such as magnetron sputtering and electron beam plasma vapor deposition may be used. When thickness concerns are not present, various thermal spray techniques such as low pressure plasma spray and HVOF (high velocity oxy-fuel) techniques may be utilized. The Ni—Al—Hf material which is deposited may have a composition consisting of about from about to 5.5 to 15.0 wt %, preferably from about 5.5 to 13.5 wt %, aluminum, from about 0.001 to 5.0 wt %, preferably from about 0.001 to 0.4 wt %, hafnium, and the balance nickel.

Following deposition of the Ni—Al—Hf material, the substrate 10 with the deposited layers 14 and 16 is subjected to a diffusion heat treatment. The diffusion heat treatment is carried out at a temperature in the range of from about 1200 to about 2100 degrees Fahrenheit for a time period in the range of from about 2.0 to 15 hours. The diffusion treatment is preferably carried out in an inert gas atmosphere such as an argon atmosphere. The fully heat treated Ni—Pt—Al—Hf bondcoat may have a thickness in the range of from about 1.0 to 5.0 mils and a composition consisting of from about 5.0 to 70 wt %, preferably 10 to 60 wt % platinum, 5.5 to 15 wt %, preferably from 5.5 to 13.5 wt %, aluminum, 0.001 to 5.0 wt %, preferably from 0.001 to 0.4 wt % hafnium, and the balance nickel.

Once the bondcoat is formed, a ceramic topcoat 20 may be applied using any suitable ceramic composition known in the art. A preferred composition for the ceramic topcoat 20 is yttria stabilized zirconia such as 7.0 wt % yttria stabilized zirconia. Other favorite compositions include zirconia based pyrochlores, 5 to 60 mol % gadolinia stabilized zirconia, and zirconia stabilized with various lanthanide sesquioxides and mixtures thereof as described in U.S. Pat. No. 6,730,422, which is incorporated by reference herein. The ceramic topcoat layer 20 may have a thickness in the range of from about 1.0 to 50 mils, preferably from 3.0 to 15 mils.

The ceramic topcoat 20 may be applied using any suitable deposition technique known in the art. A preferred deposition technique is electron beam physical vapor deposition (EB-PVD). Ceramic coatings are preferably applied to bondcoated substrates at substrate temperatures ranging from 1700 to 2200 degrees Fahrenheit, and chamber pressures of 0.1 to 1.0 millitorr. Deposition time ranges from 20 to 120 minutes using feedstock feedrates of 0.2 to 1.5 inches per hour. Other suitable deposition techniques include thermal spraying, chemical vapor deposition, and other physical vapor deposition techniques, including, but not limited to, cathodic arc deposition, sputtering, and thermal evaporation. Either an inert or reactive atmosphere can optionally be used in all of these deposition techniques as known to be appropriate by one skilled in the art.

When produced by vapor deposition techniques, the ceramic topcoat layer 20 is characterized by a columnar grained microstructure with the columnar grains or columns being oriented substantially perpendicular to the surface 12. The columnar grains or columns extend outwardly from the bondcoat or from an aluminum oxide scale layer 18 that is intentionally formed on the bondcoat before or during deposition of the ceramic layer 20. In addition, vapor deposition techniques that utilize means to increase the mobility of vapor species on the substrate surface, such as substrate bias or high-energy ion impingement, result in dense equiaxed ceramic coatings. Alternatively, thermally sprayed coatings that form by depositing liquid droplets on the substrate have a porous microstructure consisting of randomly piled frozen splats of liquid. These splats are typically microcracked and typically trap pores between them, resulting in a strain-tolerant microstructure.

Figure 2:
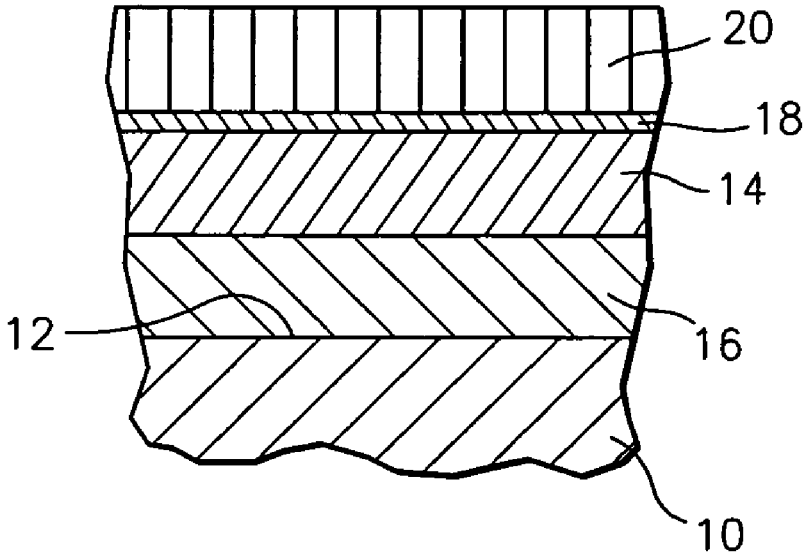
FIG. 2 is a schematic representation of a second coating system in accordance with the present invention.

Referring now to FIG. 2, there is shown an alternative sequence for forming a coating system in accordance with the present invention. In this method, the bondcoat is formed by depositing the Ni—Al—Hf layer 16 onto the surface 12 of the substrate and then depositing the platinum layer 14 over the Ni—Al—Hf layer 16. The Ni—Al—Hf layer may have the same composition as described above and may be deposited using the technique described above. The platinum layer 14 may have the same compositional range as described above and may be deposited using the electroplating technique described above. The diffusion heat treatment step is performed after the platinum depositing step using the same parameters as described above. The preferred bondcoat thickness is the same as that discussed in the prior method. The ceramic topcoat layer 20 may be deposited as discussed above.

Several specimens coated in accordance with the present invention have survived greater than 1000 hours of cyclic oxidation in a burner rig at temperatures in excess of 2000 degrees Fahrenheit.

It is apparent that there has been provided in accordance with the present invention a high strength nickel-platinum-aluminum-hafnium bondcoat which fully satisfies the objects, means and advantages set forth hereinbefore. While the present invention has been described in the context of specific embodiments thereof, other unforeseeable alternatives, modifications, and variations will become apparent to those skilled in the art having read the foregoing description. Accordingly, it is intended to embrace those alternatives, modifications, and variations as fall within the broad scope of the appended claims.

What is claimed is:

1. A method for forming a coating on a substrate comprising the steps of:

providing a substrate;

depositing a layer of platinum onto a surface of said substrate;

depositing a Ni—Al—Hf layer onto said platinum layer;

said Ni—Al—Hf depositing step comprising depositing a Ni—Al—Hf material consisting of from about 5.0 to 15 wt % aluminum, from about 0.001 to 5.0 wt % hafnium, and the balance nickel; and heat treating said substrate with said deposited layers to form a Ni—Pt—Al—Hf bondcoat.

2. The method according to claim 1, wherein said substrate providing step comprises providing a substrate formed from a nickel based alloy.

3. The method according to claim 1, wherein said platinum layer depositing step comprises electroplating said platinum layer on said substrate surface.

4. The method according to claim 1, wherein said platinum depositing step comprises depositing a layer of platinum having a thickness in the range of from about 0.01 to 1.0 mil.

5. The method according to claim 1, wherein said heat treating step comprises forming said bondcoat with platinum being present in an amount from about 5.0 to 70 wt %.

6. The method according to claim 1, wherein said heat treating step comprises forming said bondcoat with platinum being present in an amount from about 10 to 60 wt %.

7. The method according to claim 1, wherein said Ni—Al—Hf depositing step comprises depositing said Ni—Al—Hf coating using a cathodic arc deposition process.

8. The method according to claim 1, wherein said Ni—Al—Hf depositing step comprises depositing a Ni—Al—Hf material consisting of from about 5.5 to 13.5 wt % aluminum, from about 0.001 to 0.4 wt % hafnium, and the balance nickel.

9. The method according to claim 1, wherein said heat treating step comprises heating said substrate with said deposited layers at a temperature in the range of from about 1200 to about 2100 degrees Fahrenheit for a time period in the range of from about 2.0 to 15 hours to form said bondcoat.

10. The method according to claim 1, further comprising applying a ceramic topcoat over said bondcoat having a thickness in the range of from about 1.0 to 50 mils.

11. The method according to claim 10, wherein said ceramic topcoat applying step comprises applying a ceramic topcoat having a thickness in the range of from about 3.0 to 15 mils.

12. The method according to claim 10, wherein said ceramic topcoat applying step comprises applying a yttria stabilized zirconia topcoat.

13. The method according to claim 10, wherein said ceramic topcoat applying step comprises applying a zirconia based pyrochlore topcoat.

14. The method according to claim 10, wherein said ceramic topcoat applying step comprises applying a 5 to 60 mol % gadolinia stabilized zirconia.

15. The method according to claim 10, wherein said ceramic topcoat applying step comprises applying said topcoat using an EB-PVD technique and thereby forming said topcoat with a columnar grained microstructure wherein columnar grains are oriented substantially perpendicular to said substrate surface and extend outwardly from the bondcoat.

16. A method for forming a coating on a substrate comprising the steps of:

providing a substrate;

depositing a Ni—Al—Hf layer onto a surface of said substrate;

said Ni—Al—Hf depositing step comprising depositing a Ni—Al—Hf material consisting of from about 5.0 to 15 wt % aluminum, from about 0.001 to 5.0 wt % hafnium, and the balance nickel;

depositing a layer of platinum over said Ni—Al—Hf layer; and heat treating said substrate with said deposited layers to form a Ni—Pt—Al—Hf bondcoat.

17. The method according to claim 16, wherein said substrate providing step comprises providing a substrate formed from a nickel based alloy.

18. The method according to claim 16, wherein said platinum layer depositing step comprises electroplating said platinum layer on said Ni—Al—Hf layer.

19. The method according to claim 16, wherein said platinum depositing step comprises depositing a layer of platinum having a thickness in the range of from 0.01 to 1.0 mil.

20. The method according to claim 16, wherein said heat treating step comprises forming said bondcoat with platinum being present in an amount from about 5.0 to 70 wt %.

21. The method according to claim 16, wherein said heat treating step comprises forming said bondcoat with platinum being present in an amount from about 10 to 60 wt %.

22. The method according to claim 16, wherein said Ni—Al—Hf depositing step comprises depositing said Ni—Al—Hf coating using an cathodic arc deposition process.

23. The method according to claim 16, wherein said Ni—Al—Hf depositing step comprises depositing a Ni—Al—Hf material consisting of from about 5.5 to 13.5 wt % aluminum, from about 0.001 to 0.4 wt % hafnium, and the balance nickel.

24. The method according to claim 16, wherein said heat treating step comprises heating said substrate with said deposited layers at a temperature in the range of from about 1200 to about 2100 degrees Fahrenheit for a time period in the range of from about 2.0 to 15 hours to form said bondcoat.

25. The method according to claim 16, further comprising applying a ceramic topcoat over said bondcoat having a thickness in the range of from about 3.0 to 12 mils.

26. The method according to claim 25, wherein said ceramic topcoat applying step comprises applying a yttria stabilized zirconia topcoat.

27. The method according to claim 25, wherein said ceramic topcoat applying step comprises applying a zirconia based pyrochlore topcoat.

28. The method according to claim 25, wherein said ceramic topcoat applying step comprises applying a 5 to 60 mol % gadolinia stabilized zirconia topcoat.

29. The method according to claim 25, wherein said ceramic topcoat applying step comprises applying said topcoat using an EB-PVD technique and thereby forming said topcoat with a columnar grained microstructure wherein columnar grains are oriented substantially perpendicular to said substrate surface and extend outwardly from the bondcoat.

* * * * *